US006722428B2

(12) United States Patent
Yokley

(10) Patent No.: US 6,722,428 B2
(45) Date of Patent: Apr. 20, 2004

(54) APPARATUS FOR SUSPENDING A PIPE WITHIN A WELL CASING

(75) Inventor: John N. Yokley, Kingwood, TX (US)

(73) Assignee: Dril-Quip, Inc., Houston, TX (US)

( * ) Notice: Subject to any disclaimer, the term of this patent is extended or adjusted under 35 U.S.C. 154(b) by 58 days.

(21) Appl. No.: 10/146,785

(22) Filed: May 16, 2002

(65) Prior Publication Data

US 2002/0170709 A1 Nov. 21, 2002

Related U.S. Application Data

(60) Provisional application No. 60/292,049, filed on May 18, 2001, and provisional application No. 60/316,572, filed on Aug. 31, 2001.

(51) Int. Cl.[7] ..... E21B 23/01
(52) U.S. Cl. ..... 166/217; 166/216
(58) Field of Search ..... 166/134, 206–208, 166/216, 217; 175/423

(56) References Cited

U.S. PATENT DOCUMENTS 3,095,627 A 7/1963 Johnson
3,096,554 A 7/1963 Johnson
3,130,987 A 4/1964 Johnson
3,893,717 A 5/1974 Nelson
4,711,326 A 12/1987 Baugh et al.
4,762,177 A 8/1988 Smith, Jr.
4,926,936 A 5/1990 Braddick
5,131,468 A 7/1992 Lane et al.
5,253,710 A 10/1993 Carter et al.
6,119,774 A 9/2000 Doane et al.
6,241,017 B1 * 6/2001 Doane et al. ..... 166/134

* cited by examiner

*Primary Examiner*—David Bagnell
*Assistant Examiner*—Brian Halford
(74) *Attorney, Agent, or Firm*—Loren G. Helmreich; Browning Bushman, P.C.

(57) ABSTRACT

An apparatus suspends a pipe from the lower end of a tubular body positioned concentrically within an outer casing. Pockets are formed about the outer circumference of the body, each to receive a cone having an inner conical side adjacent the inner wall of each pocket, and a slip having an inner conical side adjacent an outer conical side of the cone. Slots are formed in side walls of the pocket for guiding the slip an securing the slip and cone with respect to the body.

4 Claims, 13 Drawing Sheets

APPARATUS FOR SUSPENDING A PIPE WITHIN A WELL CASING

RELATED CASES

This application claims the benefit of U.S. Provisional Application Ser. No. 60/292,049 filed May 18, 2001, U.S. Provisional Application Ser. No. 60/316,572 filed Aug. 31, 2001, and U.S. patent application Ser. No. 10/004,588 filed Dec. 4, 2001.

FIELD OF THE INVENTION

This invention relates generally to an apparatus for suspending a pipe within a well casing. More particularly, it relates to improvements in which the pipe is suspended within the casing by slips spaced equally about a body and adapted to be raised over a conical surface thereabout for expansion radially outwardly into gripping engagement with the casing.

BACKGROUND OF THE INVENTION

It is known that, in the design of a slip, a compromise must be made between slips of shallow taper and large taper—i.e., small or large angles between their cylindrical and conical surfaces. Although desirable from the standpoint of spreading radial loads on the pipe and casing, the shallow tapers increase the radial loads on the pipe and casing, and thus increase the possibility of collapsing the pipe and/or bursting the casing.

It is also known to reduce radial loading by means of "controlled friction" due to blunt teeth formed on the sides of the slips opposite the teeth for galling the surface over which the slips are slidable.

It is further known to reduce radial loading by means of slip assemblies of such construction as to exert circumferential loads on the body in order to mimic radial loads. An improved apparatus and method is desired for suspending a pipe within a well casing.

SUMMARY OF THE INVENTION

According to the primary object of this invention, each of the slips is of such design that it combines desirable features of all three concepts so as to minimize the risk of collapsing the pipe and/or bursting the casin It is a further object to provide a slip assembly of such construction that although the pipe and casing would ordinarily be subjected to radial loading due to the shallow taper of the slips, these loads are minimized by both controlled friction and circumferential loading.

These and other objects are accomplished, in accordance with an illustrative and preferred embodiment, by apparatus in which a tubular body from which the pipe is suspended is adapted to be lowered into the bore of the casing so as to suspend the pipe therein has longitudinally extending, equally spaced pockets disposed about and concentric with the outer circumference of the body with each pocket having an open face, side walls, and upper and lower end walls. A cone is adapted to be installed within each pocket beneath the upper wall thereof and has an inner cylindrical surface concentric with the body, a downwardly and inwardly extending outer conical surface, and opposite side edges engaging side walls of the pockets. A slip having teeth on its outer side has an inner conical surface concentric with the outer conical surface of each cone for sliding upwardly and vertically with respect thereto. The inner and outer sides of each slip form a relatively small vertical angle with respect to one another, preferably in the range of 2–4 degrees.

Each side wall of each pocket has a slot adjacent to and extending parallel to the outer conical surface of each cone when in the pocket, and a rib is provided on each lateral side of each slip for fitting closely within a slot as the slip is lowered into the pocket for landing on lower end wall of the pocket so as to retain the cone and slip within the pocket. The slip may be raised over the cone by means of a tie bar having a vertical actuator, for sliding upwardly over the outer conical surface of the cone, to cause the slip teeth to grip the casing and thus suspend the pipe within the casing as the weight of the pipe is slacked off. A tight fit of the side edges of the cone within the side walls of the pocket cause the load to be transmitted to the body in a circumferential direction, and thus as loop loading. The inner side of each slip has relatively blunt teeth for galling the outer side of the adjacent cone when the teeth on the outer side of the slip have engaged the bore of the casing and the weight of the pipe is slacked off onto the casing.

BRIEF DESCRIPTION OF THE DRAWINGS

FIG. 6AA is an enlarged detail view of the portion encircled on FIG. 6; and

DETAILED DESCRIPTION OF THE PREFERRED EMBODIMENTS

Figure 5:
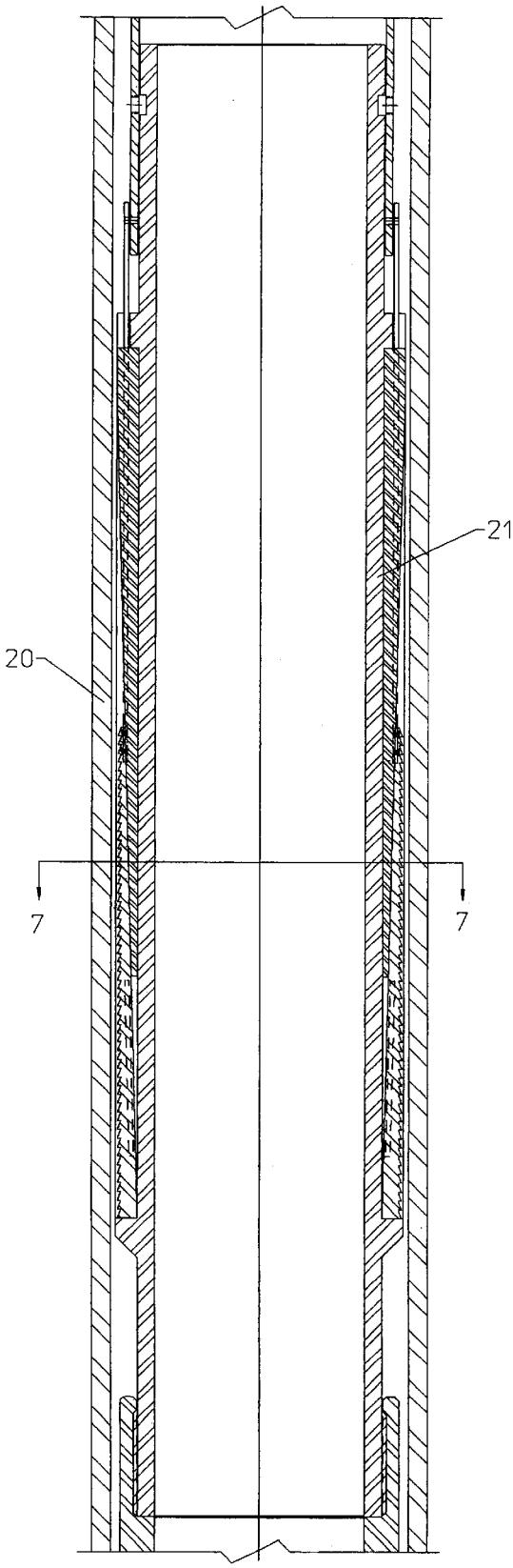
FIG. 5 is a vertical sectional view of the body similar to FIG. 3 but showing the apparatus within a well casing.
Figure 5A:
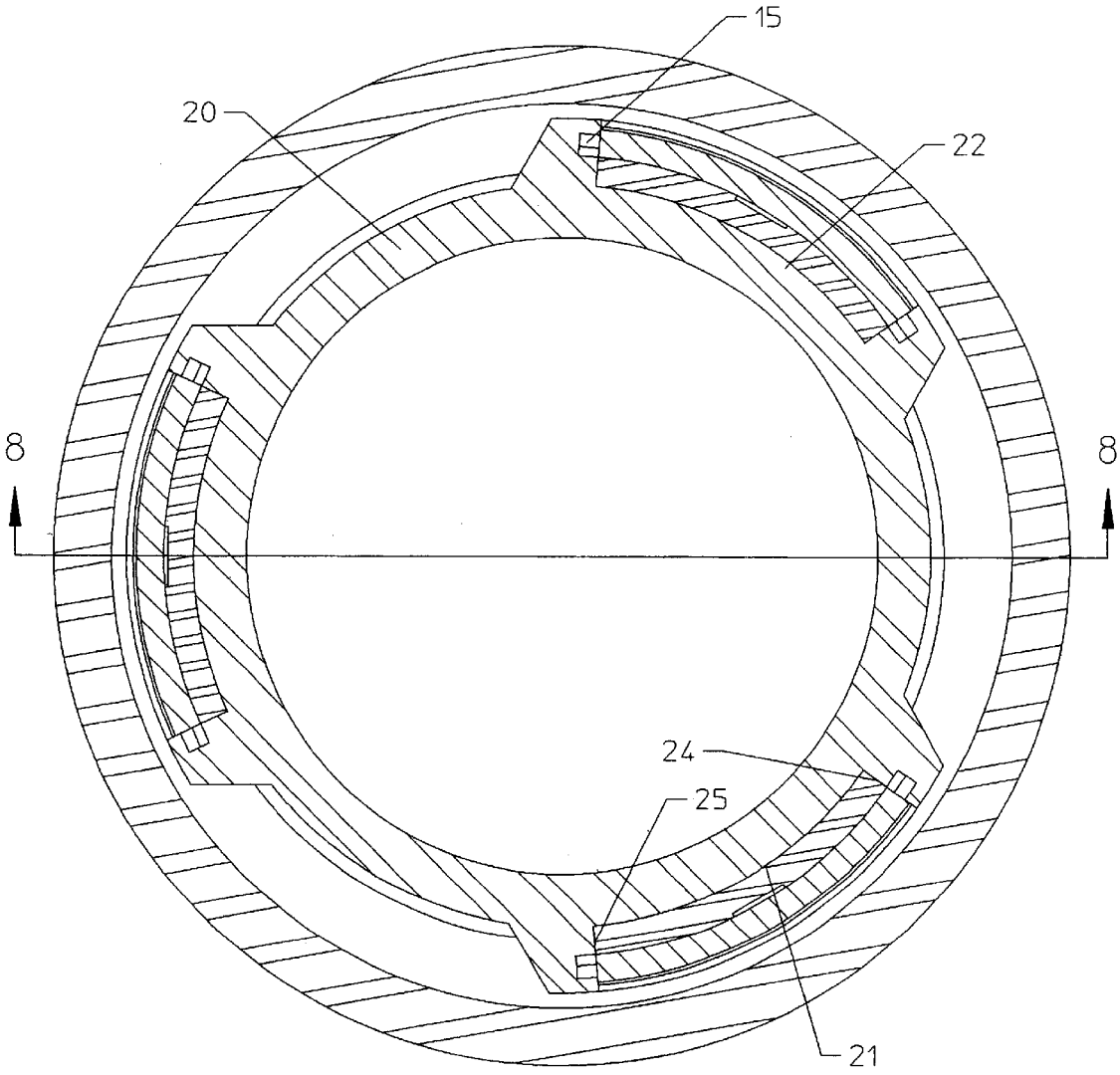
FIG. 5A is a cross-sectional view of the hanger body, slip assembly and casing, as shown along broken line 7—7 of FIG. 5.
Figures 6, 6A:
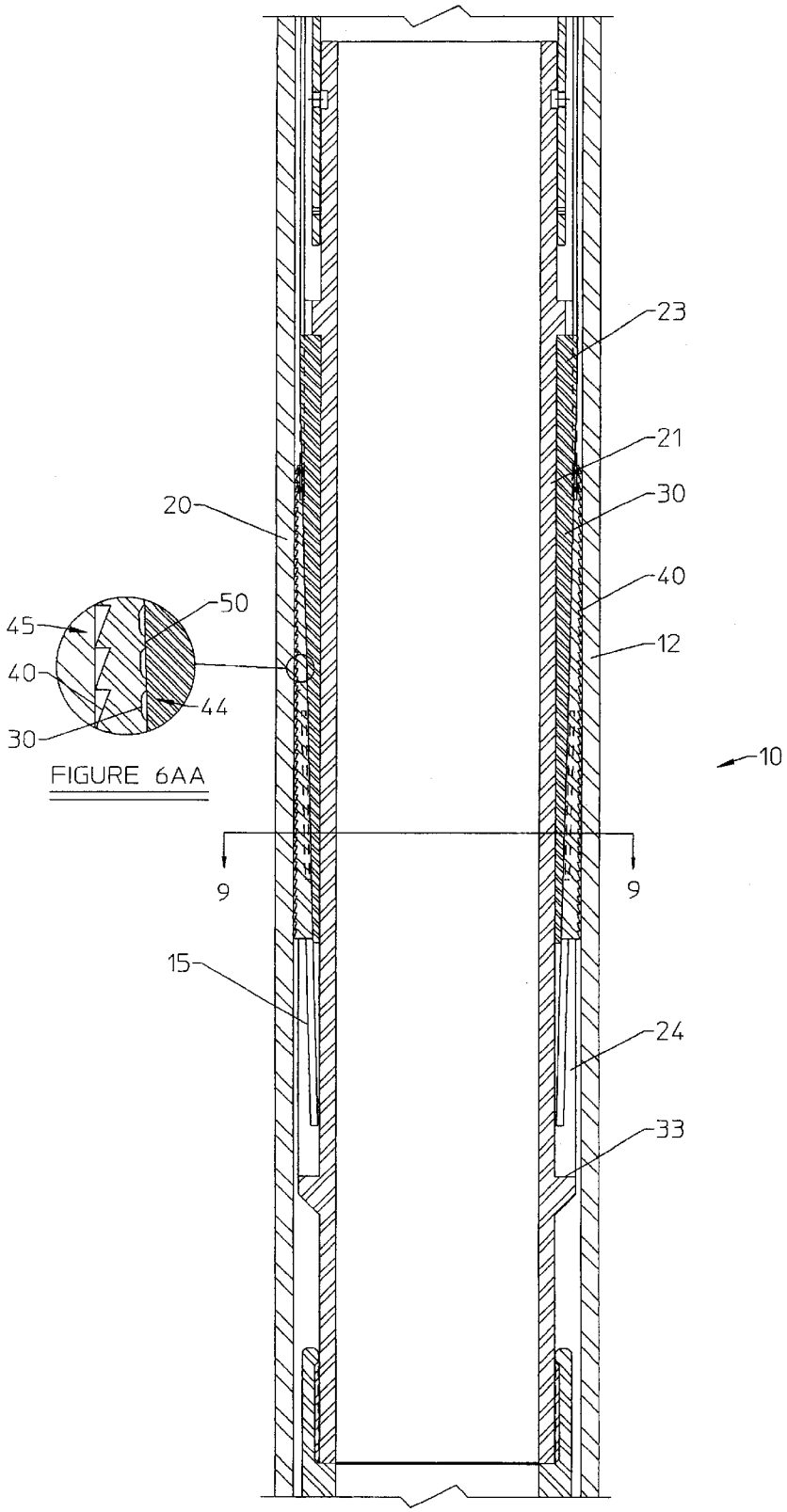
FIG. 6 is a vertical sectional view similar to FIG. 5, and as seen along line 7—7 in FIG. 5, but upon raising of the slip into engagement with the bore of the well casing, whereby the weight of the body and pipe suspended therefrom may be slacked off onto the casing.
FIG. 6A is another cross-sectional view of the apparatus, as seen along broken line 9—9 of FIG. 6.
Figure 6A:
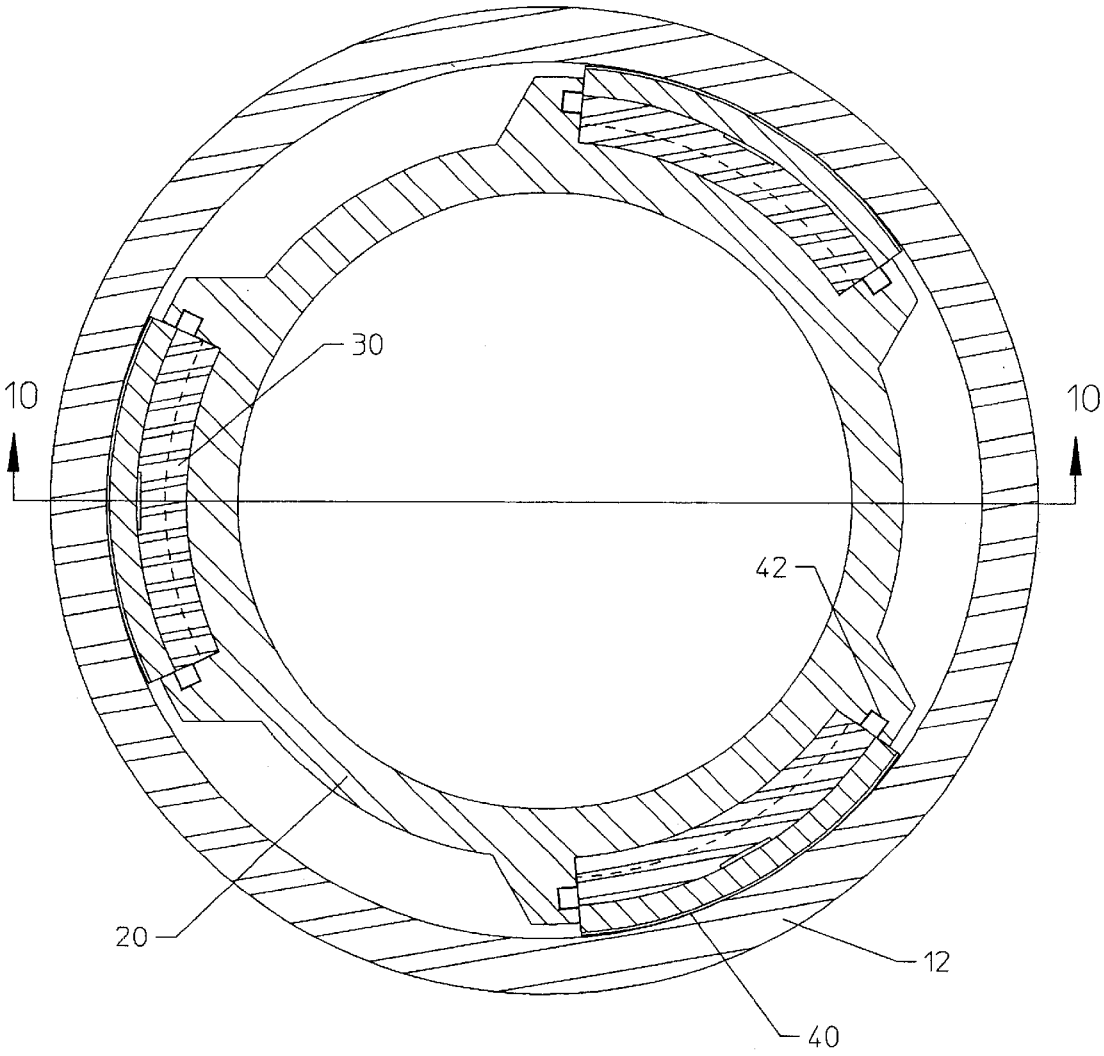

An apparatus is shown generally at 10 to comprise a tubular body 20 having a bore 18 from which a pipe (not shown) may be suspended within a casing 12, as shown in FIGS. 5 and 6. As previously mentioned, this body may be a liner hanger for use in suspending a liner within a well casing. The body has equally spaced apart pockets 21 formed about its circumference. Each such pocket 21 includes a radially outward open face 22 preferably concentric to the body 20, and has upper and lower arcuate walls 23 and 33, which extend radially from the body 20, as well as side walls 24 and 25, which extend radially from the axis of the body 20.

A slot 15 is formed in each side wall 24, 25 to extend vertically along a relatively small angle with respect to the axis of the body 20, for extension upwardly and outwardly with respect to the axis of the body 20, with its lower end terminating above the lower wall 33 of the pocket 21 and its upper end terminating at a point beneath the upper wall 23 of the pocket 21.

A cone 30 is adapted to be installed in each pocket 21 with an inner cylindrical surface close about the open face 22 of the pocket 21 and an outer conical surface extending upwardly and outwardly. More particularly, the outer conical surface of the cone 30 forms a relatively small angle with respect to the inner cylindrical surface corresponding to an angle at which the slots 15 extend.

Upon installation of the cone 30 into the pocket 21 to a position in which its upper end 47 engages the upper wall 23 of the pocket 21, its lower end 48 is disposed above the lower end 33 of the pocket 21. Inner cylindrical surfaces of the cones 30 fit closely about the open faces 22 of the pockets 21 and lateral sides thereof fit tight against the side walls 24, 25 of the pocket 21. An outer conical face or side 38 of the cone 30 has a relief groove 35 formed vertically therein, for a purpose to be described.

The apparatus further includes slips 40 having conically shaped inner sides 44 conforming to the outer conical face 38 of the cone 30, and a substantially cylindrical outer toothed surface 45 concentric with the axis of the body 20. Ribs 42 are provided on each side of the slip 40 for fitting closely and sliding vertically within the slot 15 on the adjacent side of the pocket 21 until each of their lower ends is over the outer side of the adjacent cone, and each lower end lands on the lower wall 33 of the pocket 21.

Since the slots 35 and ribs 42 are adjacent to the outer sides of the cones 30, this positioning of the slip 40 will cause its inner conical side 44 to fit closely over the outer conical side 38 of the adjacent cone 30. Thus, mounting of the slip 40 will retain the cone 30 in place within the pocket 21, free for sliding movement along the outer conical face 38 of the cone 30. As illustrated in FIG. 6 and in the enlarged detail in FIG. 6AA, blunt teeth 50 are formed on the inner cylindrical side 44 of each slip 40.

Figure 1:
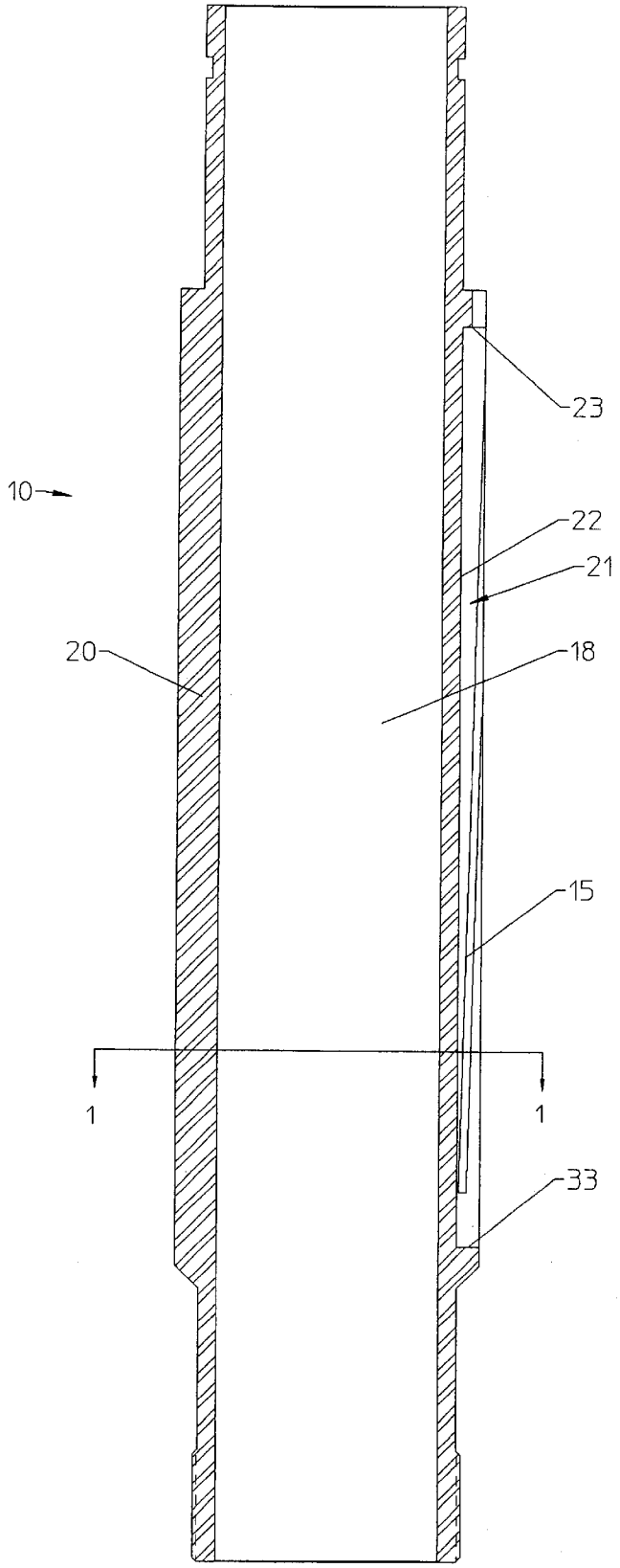
FIG. 1 is a vertical sectional view of the body of the apparatus, as seen along line 2—2 of FIG. 1A.
Figure 1A:
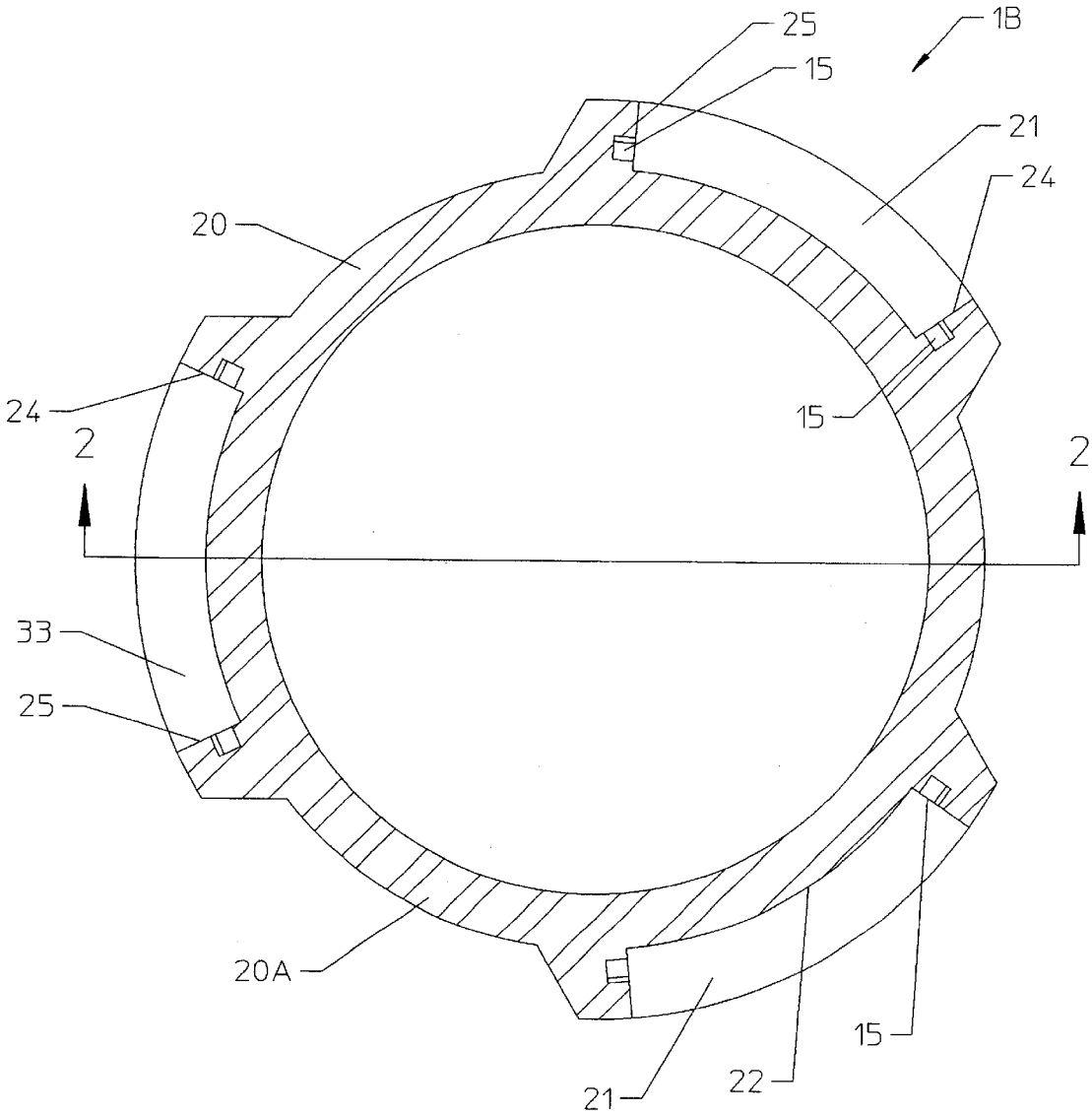
FIG. 1A is an enlarged cross-sectional view of the body, as seen along line 1—1 of FIG. 1.
Figure 1B:
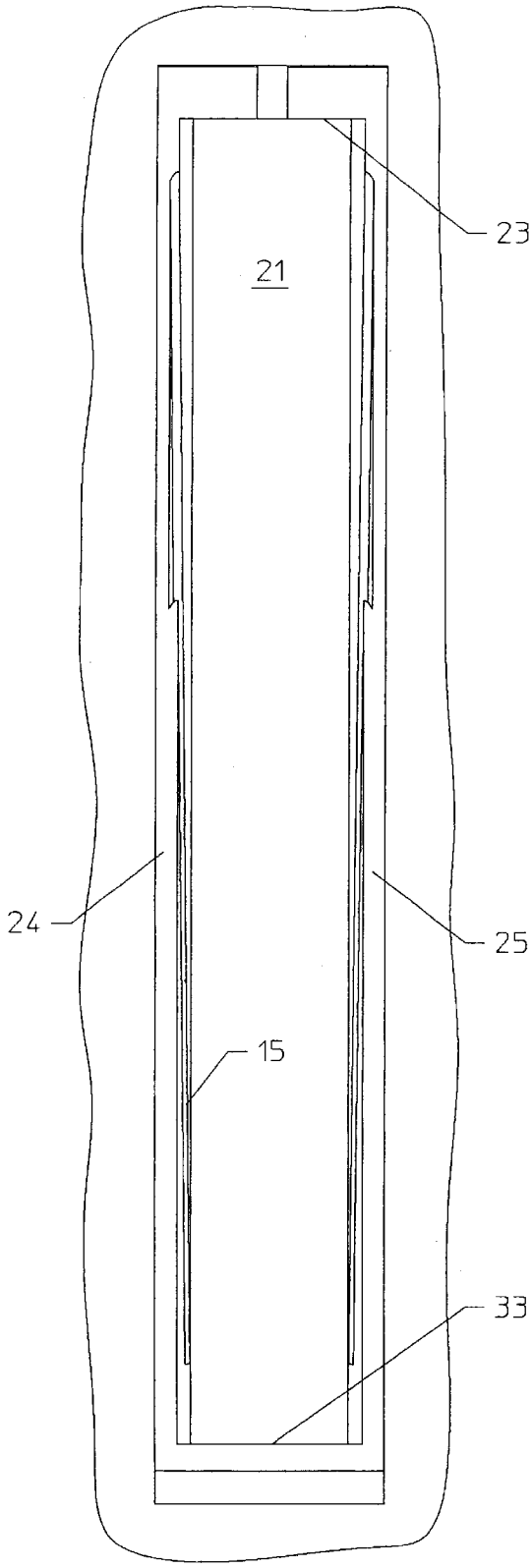
FIG. 1B is a side view of the body looking in the direction of the pocket.
Figure 2:
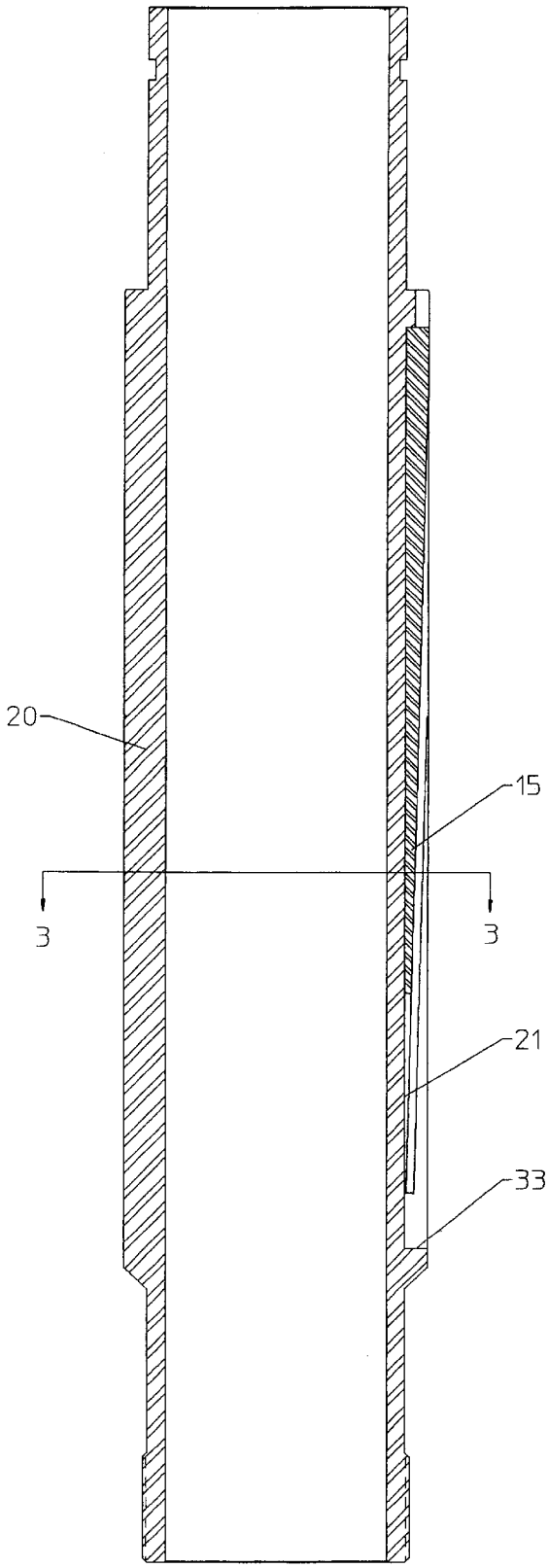
FIG. 2 is another vertical section of the body with a cone installed within the pocket thereof as shown along line 4—4 of FIG. 2A.
Figure 2A:
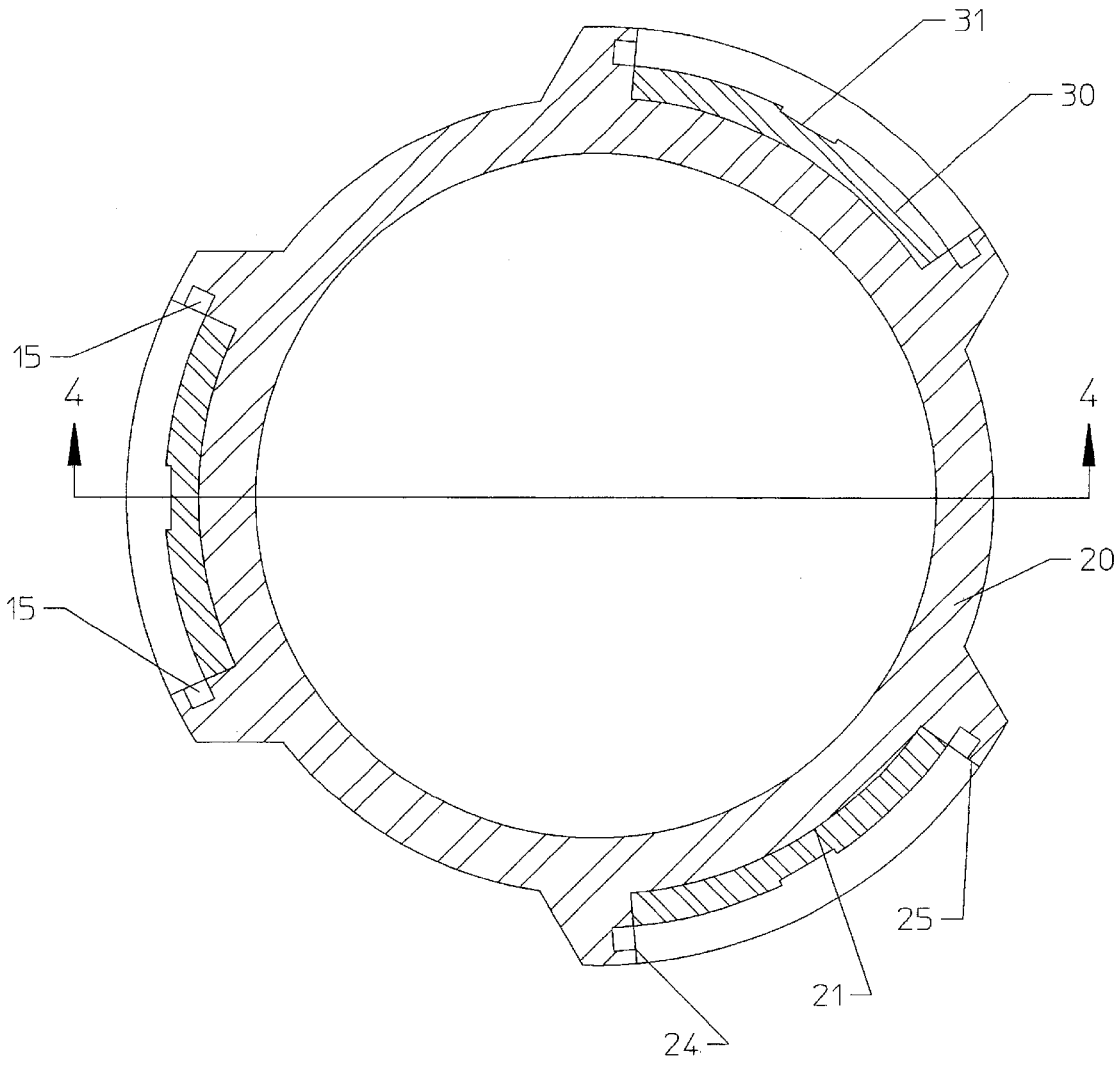
FIG. 2A is an enlarged cross-sectional view of FIG. 2, as seen along broken line 3—3 lines of FIG. 2.
Figure 3:
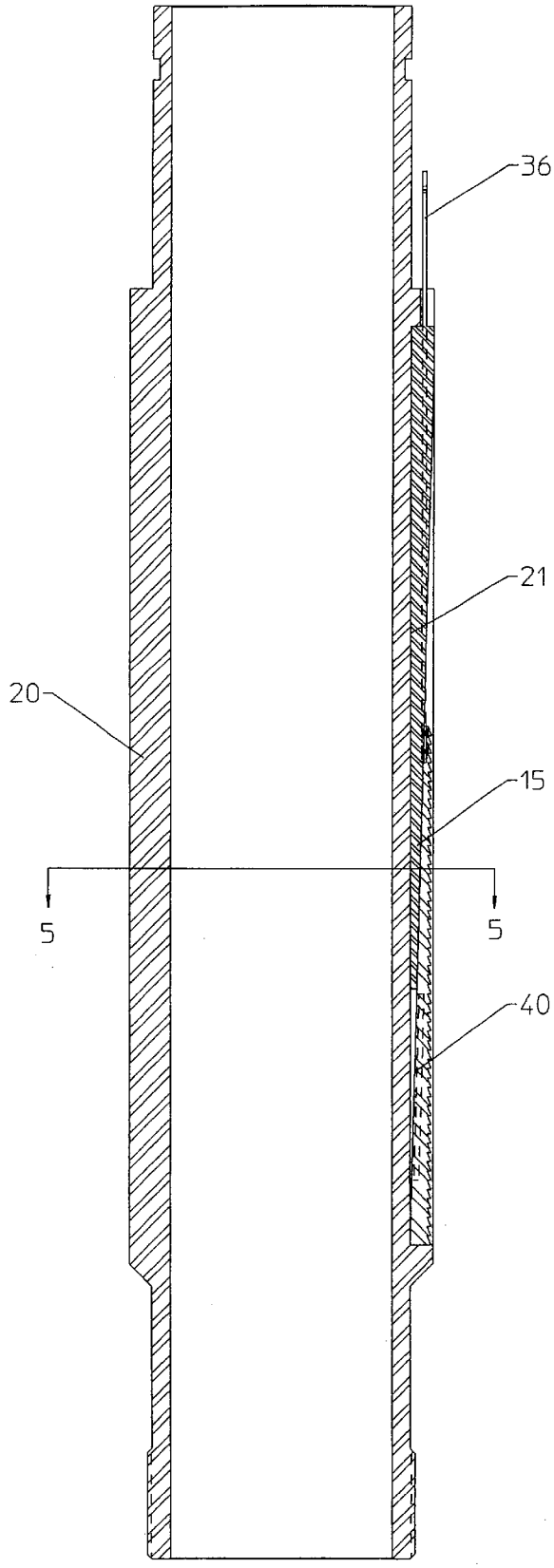
FIG. 3 is another vertical sectional view of the body along line 6—6 of FIG. 3A, upon installation of a slip over the outer side of the cone within the pocket.
Figure 3A:
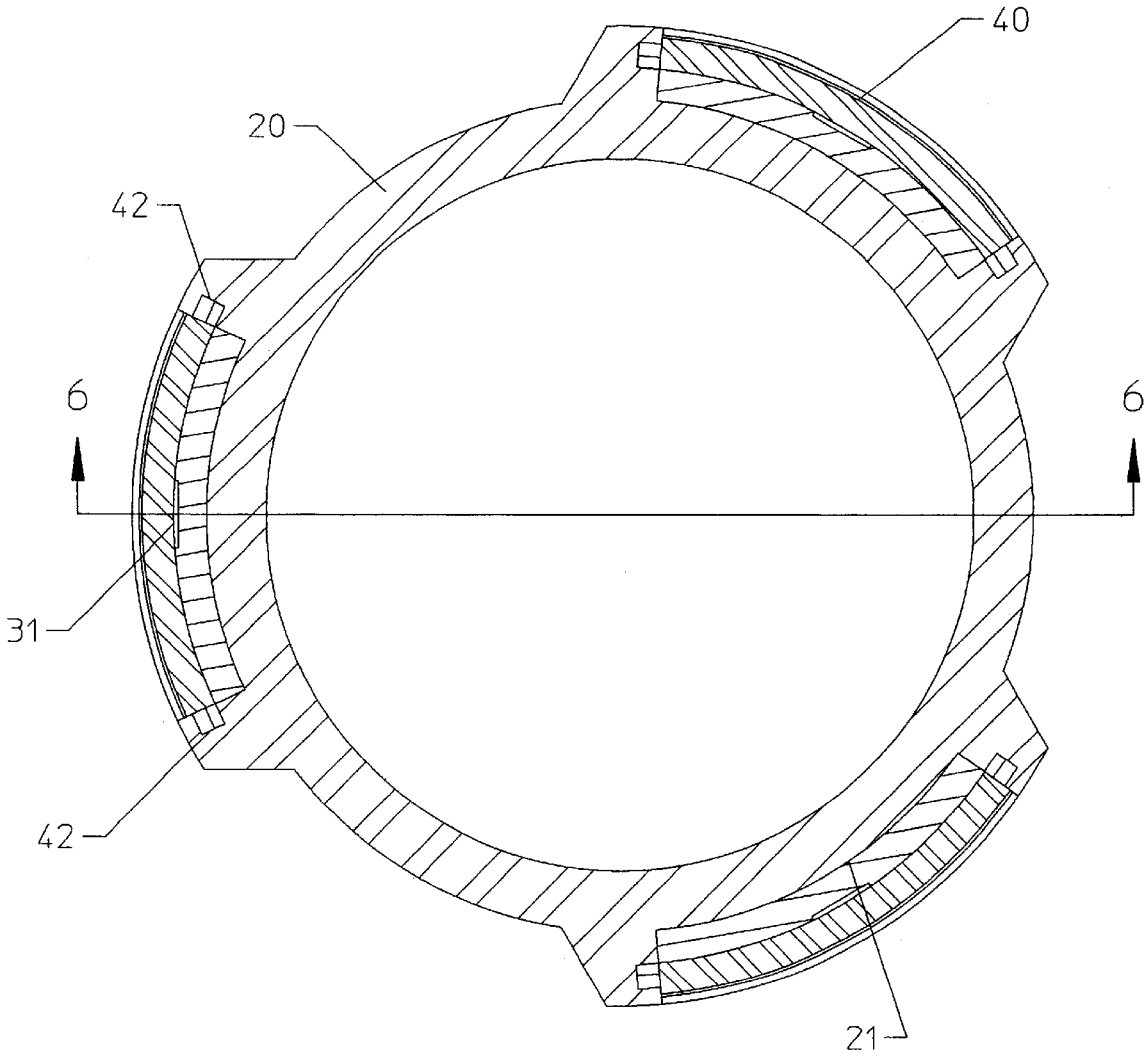
FIG. 3A is another enlarged cross-sectional view of the hanger body as seen along line 5—5 of FIG. 3, and showing the ribs on the sides of the slips fitting within the slots in the sides of the pocket so as to hold the cones against the inner faces of the pocket.
Figure 4:
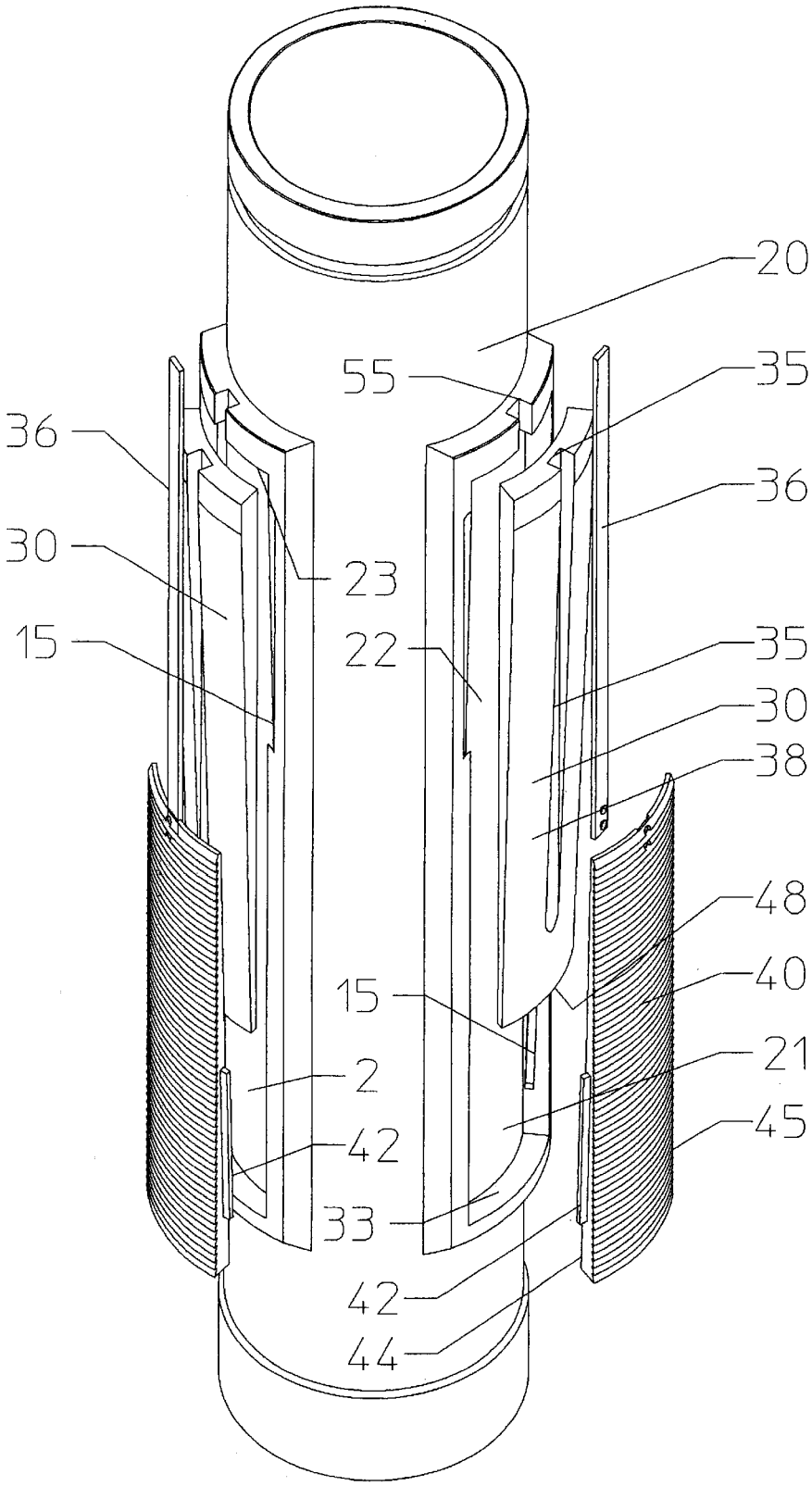
FIG. 4 is a perspective vertical view of the hanger body with the cone and slip removed from the pocket.

As best shown in FIG. 4, the outer side 38 near the upper end 47 of each cone 30 is formed with the a vertical groove 35, which is open at its upper end and aligned with a groove 55 in the upper wall 23 of the pocket 21. A tie bar 36 is fixed in any suitable manner to the upper end of each slip 40 for extension upwardly through the groove 25, 36, and its upper end is adapted for connection with a suitable actuator for raising the slip 40 with respect to the cone 30.

With the cone 30 and slip 40 assembled in each of the pockets 21 the body 20 is lowered into the casing 12, as shown in FIG. 5. When the body 20 is initially lowered, the retracted slips 40 are spaced concentrically within the inner wall of the casing 12.

At this time, the tie bars 36 for the slips 40 are lifted, so as to raise the slips 40 over the cones 30 as the ribs 42 on opposite sides of the slips 40 ride within the slots 15 on the opposite side walls 24, 25 of the pockets 21. Due to the concentric conical surfaces 38, 44 on the outer sides of the cones 30 and inner sides of the slips 40, respectively, the slips 40 are caused to move upwardly and outwardly, as their ribs 42 slide within the slots 15, and thus radially outwardly into biting engagement with the casing 12, following which the body 20 and weight of the pipe may be suspended therefrom. The blunt teeth 50 on the inner sides 44 of the slips 40 will dig into or gall the outer sides 38 of the cones 30 thereby reducing the radial loads on the body 20 and casing 12.

For reasons previously described, the inner and outer sides of the slips form a relatively small angle with respect to one another, preferably in the neighborhood of 2–4 degrees, which spreads the load imposed upon the body and casing over a large area. Although there is a corresponding increase in the magnitude of the radial loading, this is mitigated at least to some extent by the "controlled friction" resulting from the galling of the teeth on the inner sides of the slips into the front sides of the cones.

Radial loads are further mitigated by their transmission to the body in a circumferential sense, sometimes known as "hoop" loading. Thus, the cones may tend to be flattened, which tendency is promoted by the vertical relief formed in their outer diameters. As previously mentioned, this circumferential loading will further reduce the extent to which the pipe and casing are loaded in a radial sense.

Figure 7:
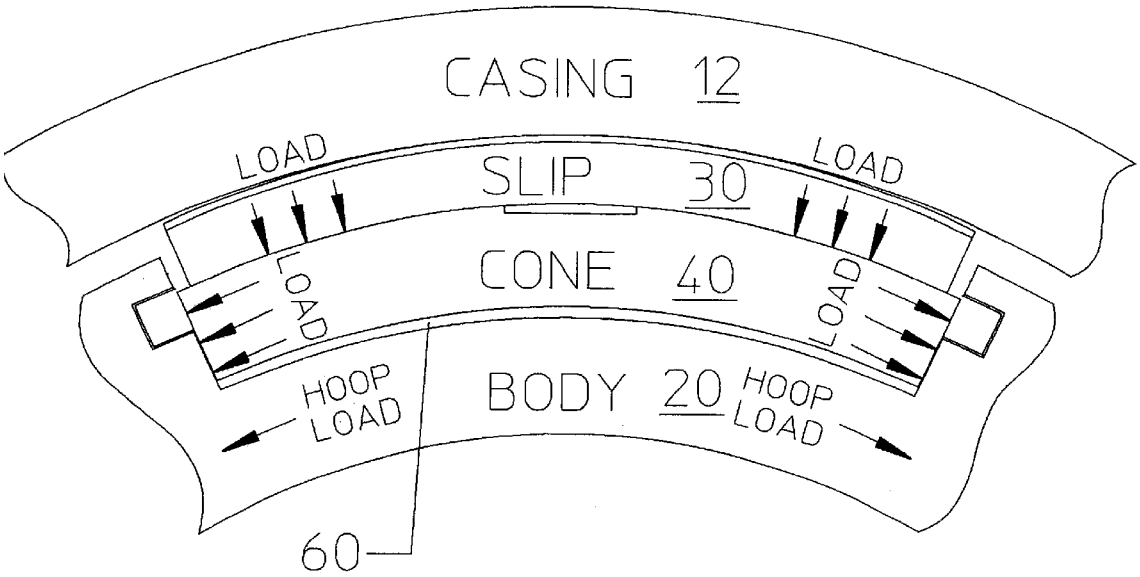
FIG. 7 is an enlarged horizontal sectional view of the body, cone, slip and casing illustrating the transmission of forces which result in circumferential or hoop loading of the body as weight is slacked off onto the casing.

As indicated diagrammatically in FIG. 7 there is initially a small gap 60, upon assembly between the inner side of the cone 40 and the radially outward open face 22 of the pocket 21. As the load is applied through the slip 40 to the cone 20 the lateral sides of the cone 30 load up onto the sides 24 and 25 of the pocket 21 in the body 20. This transmits the load through the body 20 in a "hoop" manner instead of tending to collapse the body 20 with a large radial load. As the load increases the gap 60 will decrease until it disappears so that the body 30 will accept some normal load.

Although the invention has been described in detail, it should be understood that this explanation is for illustration, and that the invention is not limited to these embodiments. Alternate components and installation techniques will be apparent to those skilled in the art in view of this disclosure.

Additional modifications are thus contemplated and may be made without departing from the invention, which is defined by the claims.

What is claimed is:

1. Apparatus for suspending a pipe within a well casing, comprising a body from which the pipe may be suspended and adapted to be lowered into the bore of the casing so as to suspend the pipe therein, longitudinally extending, equally spaced pockets disposed about and concentric with the outer circumference of the body, each pocket having an open face, side walls, and upper and lower end walls, a cone adapted to be installed within each pocket beneath the upper end wall thereof and having an inner cylindrical surface concentric with the body, a downwardly and inwardly extending outer conical surface, and opposite side edges engageable with the side walls of the pocket, a slip having teeth on its outer side and an inner conical surface concentric with the outer conical surface of the cone, the inner and outer sides of each slip forming a relatively small vertical angle with respect to one another, each side wall of each pocket having a slot adjacent to and extending parallel to the outer conical surface of each cone when in the pocket, and a rib on each lateral side of each slip for fitting closely within the slot in the pocket as the slip is lowered into the pocket for landing on its lower end wall so as to retain the cone and slip within the pocket, as the slip slides upwardly and outwardly over the conical surface of the cone as the slip is raised, to cause the slip teeth to grip the casing and thus suspend the pipe within the casing as the weight of the pipe is slacked off, inner side of each slip having relatively blunt teeth for galling the outer side of the adjacent cone after the outer teeth have engaged the bore of the casing and the weight of the pipe is slacked off onto the casing.

2. An apparatus as defined in claim 1, wherein an angle between the inner and outer surfaces of each slip is within the range of about 2 to 4 degrees.

3. An apparatus as defined in claim 1, including a tie bar having its lower end connectable to the upper end of each slip and adapted to be raised by an actuator for raising the slip.

4. An apparatus as defined in claims 1 to 3, wherein the body comprises a hanger from which a liner is suspended.

* * * * *